United States Patent [19]

Wreford-Howard

[11] 4,217,576

[45] Aug. 12, 1980

[54] LAMP OPERABILITY TESTING DEVICE FOR PLAYING MACHINE

[76] Inventor: David Wreford-Howard, 17823 La Costa, Huntington Beach, Calif. 92647

[21] Appl. No.: 890,956

[22] Filed: Mar. 28, 1978

[51] Int. Cl.[2] ..... G08B 21/00

[52] U.S. Cl. ..... 340/642; 340/653; 340/659

[58] Field of Search ..... 340/641, 642, 644, 652, 340/653, 657, 659, 660, 664, 661, 52 R

[56] References Cited

U.S. PATENT DOCUMENTS

| | | | |
|---|---|---|---|
| 3,421,157 | 1/1969 | Atkins | 340/642 |
| 3,633,196 | 1/1972 | Winkler | 340/642 |

*Primary Examiner*—Alvin H. Waring

*Attorney, Agent, or Firm*—McGlew and Tuttle

[57] ABSTRACT

Plural lamps are connected together at one end and in series with the primary winding of a transformer. The primary winding, responsive to application of an electric potential to one of the lamps, has a potential impressed there across and induces a transient in the secondary winding which generates a back E.M.F. in the secondary winding. A transistorized amplifier connected to the secondary winding amplifies the back E.M.F., and a monostable multi-vibrator has an input connected to the amplifier and is effective, responsive to the amplified back E.M.F., to effect generation of an illumination-received pulse at an output thereof. A J.K. flip-flop is connected to the multi-vibrator and is operable, responsive to receipt of the illumination-received pulse, to provide a "high" output signal indicating operability of the lamp and is operable, responsive to no signal at the output of the multi-vibrator, to provide a "low" output signal indicating inoperability of the lamp to prevent the current being applied to the lamp in the event the lamp is non-operative.

8 Claims, 1 Drawing Figure

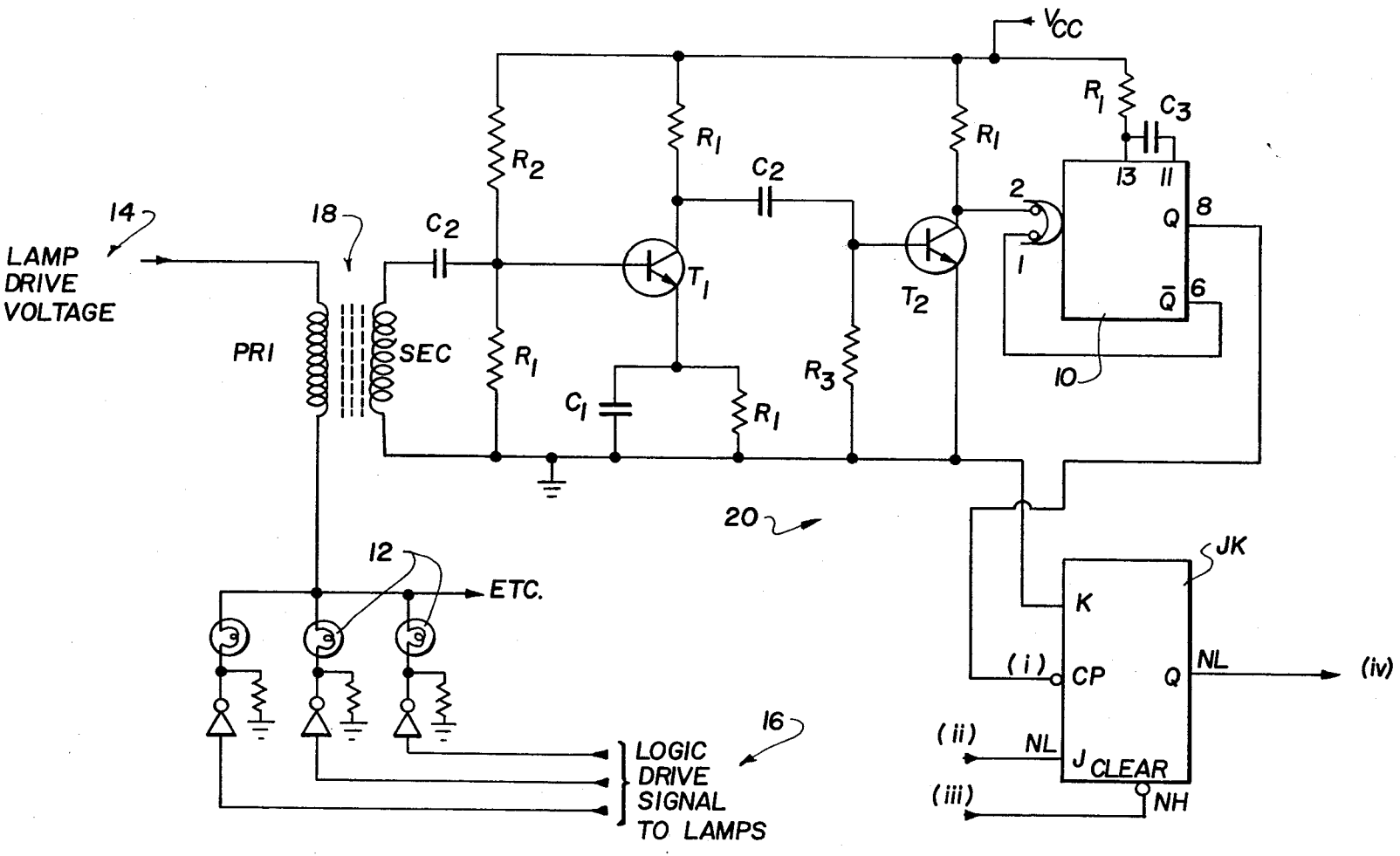
VCC
R1
C3
13
11
8
Q
6
Q̄
10
2
1
R1
T2
R3
C2
R1
T1
R1
C1
R2
R1
C2
SEC
18
PRI
14
LAMP DRIVE VOLTAGE
20
JK
NL
Q
K
CP
J
CLEAR
NH
(i)
NL
(ii)
(iii)
(iv)
16
LOGIC DRIVE SIGNAL TO LAMPS
ETC.
12

LAMP OPERABILITY TESTING DEVICE FOR PLAYING MACHINE

FIELD AND BACKGROUND OF THE INVENTION

This invention relates to improvements in detection means for detecting the non-operability of a lamp and preventing full illumination of a non-operative lamp.

When considering amusement machines such as, for example, card playing machines, one of the greatest problems is the reliability of the lamps used in the machine display. As such machines normally have inbuilt time limits and a large number of lamps, the problem of the non-operability of any one or a number of the lamps is a serious one, mainly due to the fact that a user does not know the lamp has failed.

To consider a specific example, in the U.S. Pat. No. 3,889,956 of Castle there is shown a card playing machine where, upon a particular card being illuminated the player must specifically reject the card within a certain prescribed time limit or the card is taken as having been accepted. Thus, if a particular card were selected by the machine and if the lamp for that card was non-operative, then a user would be in the position of not knowing that the particular card had been accepted and would thus not have the opportunity of rejecting the card. The card would thus be automatically accepted.

Such a situation naturally devalues the reliability and, more particularly, the integrity of such a machine as the reliability and game integrity of such a machine are dependent upon the probabilistic failure of a single display device - which may represent less than 1% of the total display complement. The ability to overcome this problem of detecting non-operative output displays has, in the past, precluded the development of a machine which was reliable and had market acceptance.

Devices for the indication of a lamp which ceases to operate are known. For example, U.S. Pat. No. 3,523,238 of Jones is directed to a device for sensing the current in a load circuit, such as runway lamps, and is directed primarily to regulating the current in such a load circuit. Referring to the Jones specification, the sensing is done by providing a constant current source for a load 1, and a current transformer 5—5 connected in series between the constant current source and the load. The secondary winding 5*b* of the current transformer is connected in a load monitoring circuit 3 including an inductance 6 and a capacitor 7. Upon any variation of the constant current supplied to the load 1, the potential drop across the capacitor 7 is proportional to the load current and this potential drop is supplied to a high impedance, voltage-sensitive detector 4 which, in turn, is connected to a signal device or to control means for restoring the constant current to a preset value. This restoration may be effected manually by adjustment of the constant current source 2.

Another example is U.S. Pat. No. 3,421,157 of Atkins which shows a device for indicating that a lamp has failed. In Atkins, there must be a full potential applied to the lamp to ascertain if it works. In contrast, the present invention is directed to a device which determines the operability of a particular lamp before full and continuous potential is applied to the lamp—that is, if the lamp is not operative it is isolated and no attempt is made to apply full and continuous potential to that lamp.

A further example is that of U.S. Pat. No. 3,987,424 of Brouwer et al, which is directed to a bulb outage warning system for informing an operator of the failure of a lamp by the detection of the steady state lamp current. This device operates by continually monitoring the lamp current but cannot detect the non-operability of a lamp before full potential is applied.

U.S. Pat. No. 3,710,157 of Wright discloses a control device for a pair of flashing airport runway lamps wherein both lamps are shut down if either fails. This is done by monitoring the surges of line current as the lamps flash and involves a comparison of signals. Upon a lamp failure being indicated, the other lamp is automatically disconnected. The same result could be achieved by placing each pair of lamps in series.

Winkler, in his U.S. Pat. No. 3,633,196 discloses a device for indicating the readiness of a lamp for operation. This particular device does this by providing continuous pulses to the lamps and then monitoring the result by a control circuit associated with each lamp and a separate monitoring circuit. With a display having a large number of lamps, the requirement for a control circuit for each lamp involves huge equipment expense and a large, complex structure.

The lamp burnout-detector described in U.S. Pat. No. 2,896,121 of Glandon is again a relatively complex structure which is designed to protect equipment in the case of arcing within a D.C. filament-type lamp. It does not relate to the detection of non-operability of the lamp and its selective isolation.

It is therefore the principal object of the present invention to provide a detection means for the detecting of the non-operability of a lamp and preventing the full illumination of such a non-operative lamp by selective isolation.

Another object of the invention is to provide such a detection means applicable to a plurality of lamps, for output indicia, connected together at one end and in series with the primary winding of a transformer having a secondary winding and associated circuitry operable to indicate the operativeness or the non-operativeness of any lamp upon attempted energization of the lamp.

The invention therefore provides a potential transformer having a primary winding connected in series between a source of electric potential and the illuminating devices, and having a secondary winding. The primary winding has a potential applied thereacross responsive to application of an electric potential to an illuminating device, resulting in a back E.M.F. being generated in the secondary winding. A transistorized amplifier circuit, a monostable multi-vibrator, and a memory element J-K are then used to control the illumination of the lamps.

For an understanding of the principles of the invention, reference is made to the following description of a typical embodiment thereof as illustrated in the accompanying drawing.

BRIEF DESCRIPTION OF THE DRAWING

The drawing is a detailed diagram of the detection circuit.

DESCRIPTION OF THE PREFERRED EMBODIMENT

The particular embodiment illustrated in the drawing is a detecting circuit for use with machines having a number of lamps each being separately and selectively illuminable. Such a machine is shown in the aforementioned U.S. Pat. No. 3,889,956 of Castle.

As is stated in that patent specification:

"When the start button is pressed, flip flops 31 and 32 are set to initiate the timer 33 and also causing the sequential momentary lighting of lamps 90 . . . ". The machine then proceeds into the normal random card selection.

Referring now to the drawing, the particular embodiment of this invention has the primary of a transformer in line with the various lamps, which are arranged in parallel. As direct current is used, there is no output from the secondary of the transformer. However, independent of any steady-state current through the primary of the transformer due to any previously illuminated lamps, the action of turning any further lamp ON induces a transient change of current and thus induces a back E.M.F. across the secondary of the transformer. The back E.M.F. is selectively amplified by the amplifying circuits of transistors $T_1$ and $T_2$ and finally shaped by a monostable multivibrator 10 having outputs $Q,\overline{Q}$. Thus, whenever a lamp driver circuit is activated and the lamp turns ON a lamp receipt pulse is generated at (i).

In contrast to this, if during the momentary sequential lighting of the lamps a particular lamp is not operative then when that lamp is attempted to be illuminated there will be no change in current and hence no transient change. This means that there is no back E.M.F. induced across the secondary of the transformer. Hence, there is no lamp receipt pulse generated at (i).

For a particular card to be dealt (when considering the present device as fitted to the machine of the aforesaid Castle patent), it is necessary for the output Q at (iv) from the lamp test memory element JK to be in the HIGH condition. One timing step prior to a particular lamp being turned ON a clear, square pulse is applied to (iii) by a suitable generator (not shown). This causes the Q output at (iv) to be set LOW. The directive for a card to be dealt from the system's random generator results in the input at (ii) being set HIGH. The output Q at (iv) will remain LOW unless an input at (i) is received—i.e. the lamp receipt pulse is generated. When a lamp receipt pulse has been generated then the output Q at (iv) is set HIGH and the card is capable of being dealt. Thus, for a card to be dealt, there must be all three inputs.

If the output at (iv) is not set HIGH then the previously illuminated lamp is turned OFF, and pending command at (ii), a card lamp is committed ON and the card thereby dealt if the lamp drew supply current and therefore the lamp and its attendent driver were assumed as being operative.

As is normal for machines of this type, once a card has been "dealt", it is removed from further future use in the game.

Thus, as can be seen, the machine, when fitted with the device of the present invention, will not attempt to illuminate a card unless the lamp for that card is operative. As the card had been selected, it is therefore removed from any further consideration during that game.

In general terms the invention is an improvement in an apparatus having a plurality of lamps 12 which are selectively connectable to a source of driving voltage 14 by a logic driving means 16. The improvement comprises a transient forming means, exemplified in the preferred embodiment by transformer 18, for producing a transient impulse which is sensed and amplified by a circuit means in the form of circuit 20. The sensed and amplified transient impulse is then fed back to the logic drive means 16 through the JK element of circuit 20. If no transient impulse is produced by the transformer 18, which indicates the selection of an inoperative lamp 12, the logic driving means 16 is activated to select another lamp 12.

For one particular construction, the following examples are given by way of example only:

$R_1$=10K ohm
$R_2$=18K ohm
$R_3$=47K ohm
$T_1$=2N3565
$T_2$=2N3565
$C_1$=330 pF
$C_3$=0.1$\mu$F
Monostable multivibrator=type 9601.

While a specific embodiment of the invention has been shown and described in detail to illustrate the application of the principles of the invention, it will be understood that the invention may be embodied otherwise without departing from such principles.

What I claim is:

1. Detection means, for detecting the non-operability of a lamp, comprising: a circuit including selection means operable to receive and selectively amplify a transient generated responsive to preliminary illumination of the lamp to provide an illumination-received pulse to allow continuous illumination of the lamp; the non-operability of the lamp being detected responsive to non-occurrence of the transient, to prevent continuous illumination of the lamp; said circuit including a source of electric potential; a potential transformer having a primary winding connected in series between said source and said illuminating lamp, and having a secondary winding; said primary winding, responsive to application of an electric potential to said lamp, having a potential impressed thereacross and inducing a transient in said secondary winding generating a back E.M.F. in said secondary winding; a transistorized amplifier connected to said secondary winding to amplify said back E.M.F.; and a monostable multivibrator having an input connected to said amplifier and effective, responsive to the amplified back E.M.F. to effect generation of the illumination-received pulse at an output thereof.

2. In an apparatus having a plurality of lamps which are selectively connectable to a source of driving voltage by logic drive means for illuminating the selected lamp, the improvement comprising:

transient forming means connected between the plurality of lamps and the source of driving voltage for producing a transient impulse when a selected lamp is illuminated and for producing no transient impulse when a selected lamp is inoperative and incapable of being illuminated; and circuit means connected between said transient forming means and the logic drive means for applying the transient impulse produced by said transient forming means to the logic drive means to maintain the illumination of the selected lamp, the logic drive means selectively connecting another lamp to the source of drive voltage when no transient impulse is produced.

3. The improvement of claim 2, wherein said transient forming means comprises a transformer having a primary winding connected between the source of driving voltage and the plurality of lamps and a secondary winding connected to said circuit means for producing the transient impulse.

4. The improvement of claim 3, wherein said curcuit means comprises an amplifier connected to said secondary winding of said transformer for amplifying a transient impulse produced in said secondary winding, a monostable multivibrator connected to said amplifier for producing a lamp receipt pulse, and a lamp test memory element connected to said monostable multivibrator, said lamp test memory element connected to the logic drive means.

5. Detection means, as claimed in claim 1, including a J.K. flip-flop connected to the output of the monostable multi-vibrator and operable, responsive to receipt of the illumination-received pulse, to prevent current being supplied to a non-operative lamp.

6. Detection means, as claimed in claim 5, including a plurality of individually energizable lamps connected together at one end and in series with said primary winding of said potential transformer.

7. Detection means, as claimed in claim 5, further including a timing device connected to said flip-flop and supplying thereto square timing pulses; said timing device, one timing step prior to an illuminating device having an electric potential applied thereto, supplying a clear square pulse to said flip-flop; said memory element, responsive thereto, providing a "low" output; said flip-flop, responsive to receipt of the illumination-received pulse from said monostable multi-vibrator and responsive to receipt of a generation command providing a "high" output pulse.

8. Detection means, as claimed in claim 7, including selectively operable means effective, when operative, to provide a "high" input to said flip-flop resulting in said "high" output of said flip-flop.

* * * * *